United States Patent [19]

Holritz et al.

[11] 4,260,318

[45] Apr. 7, 1981

[54] INSTALLATION APPARATUS FOR ESCALATORS

[75] Inventors: Robert F. Holritz, Jersey City, N.J.; Robert C. Stewart, deceased, late of Morris County, N.J., by Dorothy M. Stewart, executrix

[73] Assignee: Westinghouse Electric Corp., Pittsburgh, Pa.

[21] Appl. No.: 64,933

[22] Filed: Aug. 8, 1979

[51] Int. Cl.[3] ..... B66F 7/22

[52] U.S. Cl. ..... 414/589; 254/3 R

[58] Field of Search ..... 414/589, 590; 198/316, 198/320, 326, 330, 302; 248/544, 545; 14/72.5; 254/3 R, 3 C; 280/763, 767, 43.23, 43.24, DIG. 8; 187/18

[56] References Cited

U.S. PATENT DOCUMENTS

| | | | |
|---|---|---|---|
| 797,077 | 8/1905 | Shaw | 187/18 |
| 1,545,223 | 7/1925 | Westrate | 187/18 |
| 1,697,364 | 1/1929 | McCollum et al. | 254/3 R |
| 2,828,870 | 4/1958 | Corley | 414/589 |
| 3,259,255 | 7/1966 | Cresci | 414/590 |
| 3,707,220 | 12/1972 | Boltrek | 198/330 |
| 3,826,353 | 7/1974 | Greasley | 198/302 |
| 3,884,494 | 5/1975 | Ashby et al. | 280/DIG. 8 |
| 4,148,401 | 4/1979 | Kautetzky | 414/590 |

*Primary Examiner*—Joseph E. Valenza
*Attorney, Agent, or Firm*—D. R. Lackey

[57] ABSTRACT

Installation apparatus for installing pre-assembled escalators having upper and lower ends in an operating position between upper and lower landings, including wheeled support apparatus for supporting and transporting an escalator. Scissors lift apparatus mounted on the wheeled support apparatus, and a pivotal escalator truss support and locater assembly mounted on the scissors lip apparatus, cooperate to provide both vertical and angular adjustment of the escalator, in order to permit the upper end to be aligned with and then supported by a support wall associated with the upper landing, and to permit its lower end to be subsequently lowered into a pit associated with the floor of the lower landing.

4 Claims, 2 Drawing Figures

INSTALLATION APPARATUS FOR ESCALATORS

BACKGROUND OF THE INVENTION

1. Field of the Invention

The invention relates in general to escalators, and more specifically to apparatus for installing a preassembled escalator into its operating position between spaced landings.

2. Description of the Prior Art

Certain types of escalators are shipped to the job site at least partially assembled. U.S. Pat. No. 3,707,220 entitled "Modular Passenger Conveyor Construction", which is assigned to the same assignee as the present application, discloses an escalator of this type. The present method of installing such an escalator includes constructing costly rigging overhead. The escalator truss, less steps and balustrade, is then hoisted by the rigging, and the escalator is lowered into the desired position. The overhead rigging, which is usually made up special at each job site, is usually discarded. The steps and balustrade are then mounted on the truss.

It would be desirable to provide new and improved installation apparatus for escalators which eliminates the need to construct special rigging at each job site. It would further be desirable to provide installation apparatus for escalators which enables an escalator to be installed in such a manner that the steps and balustrade do not hinder the installation, permitting them to be pre-assembled with the escalator truss and installed as a unit.

SUMMARY OF THE INVENTION

Briefly, the present invention is new and improved escalator installation apparatus which supports the escalator truss from the bottom thereof. The escalator is lifted and oriented from this support base, completely eliminating the need for overhead rigging. Thus, the steps and balustrade are not in the way during installation, permitting them to be assembled with the truss prior to installation of the escalator. The support base includes swivel casters which permit the support base to be easily moved to the desired position relative to a pit associated with the lower landing, and relative to an escalator support wall associated with the upper landing.

The support base includes a powered scissors lift, such as a hydraulic cylinder operated scissors, and truss support and locator apparatus is pivotally mounted on the scissors. The escalator truss is supported by and fixed to the truss support and locator apparatus. The escalator is lifted to the desired position by the scissors lift apparatus, and means, such as cables and winches are provided to tilt or orient the pivotable truss support and locator apparatus, permitting the longitudinal axis of the truss to be oriented to the desired angle, such as an angle of 30° from the horizontal.

The scissors lift apparatus, in combination with the cables and winches, are then operated to orient the upper end of the escalator with the escalator support wall associated with the upper landing, and to lower the upper end until it is properly supported by the upper wall. Continued operation of the scissors and winches then directs the lower end of the truss into the pit associated with the lower landing. The escalator truss is then freed from the truss support and locater apparatus, and the scissors is completely retracted to enable the support base to be moved out from under the truss on its swivel casters.

The support base in a preferred embodiment additionally includes removable trailer wheels and a tow bar or hitch, to permit the escalator installation apparatus to be transported to the job site by a truck tractor. A vertically oriented pair of hydraulic cylinders are disposed on the installation apparatus to facilitate assembly and removal of the trailer wheels. After the escalator is removed from the installation apparatus, the trailer wheels are reinstalled and the escalator installation apparatus is transported to the next job site, or back to the factory or warehouse, for re-use.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENT

Figure 1:
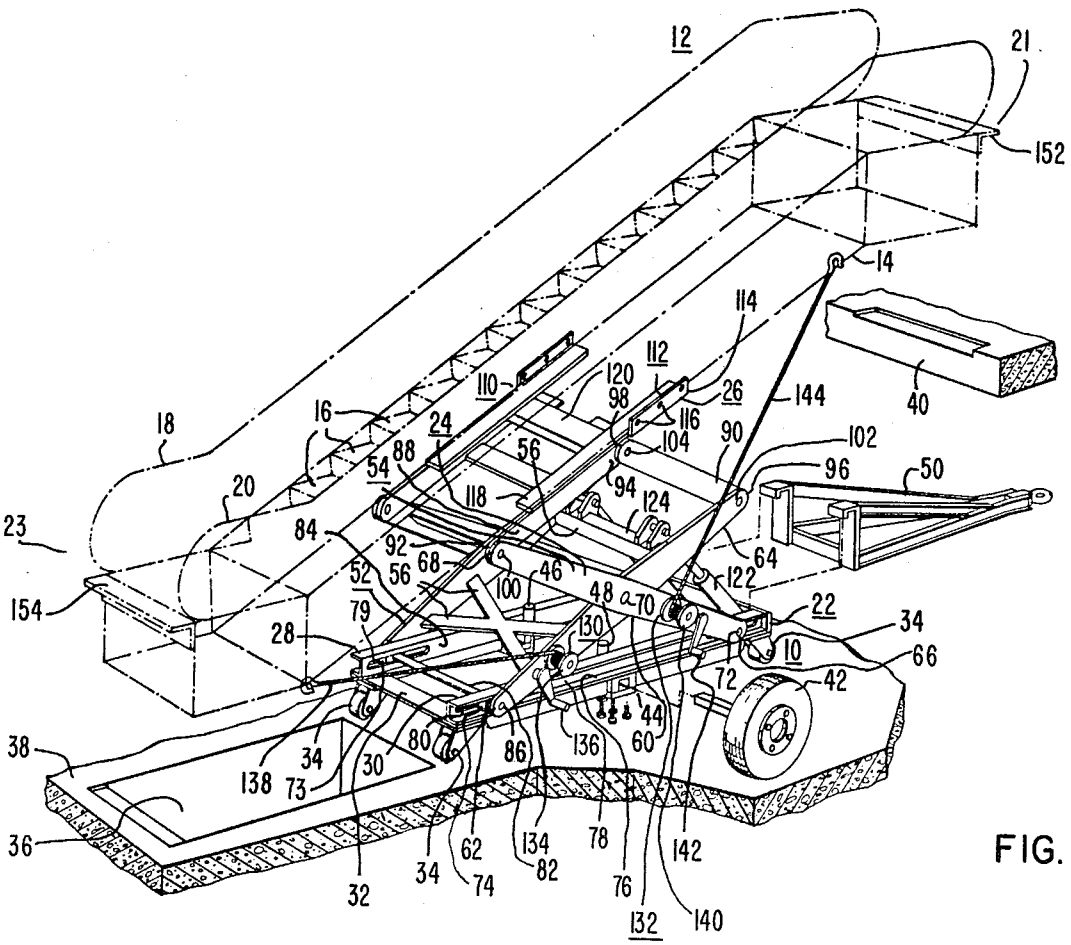
FIG. 1 is a perspective view of escalator installation apparatus constructed according to the teachings of the invention.

Referring now to the drawing, and to FIG. 1 in particular, there is shown escalator installation apparatus 10 constructed according to the teachings of the invention. Apparatus 10 is shown in an extended position, in the process of installing a pre-assembled escalator 12. Escalator 12 is shown in phantom in order to more clearly illustrate the details of the escalator installation apparatus 10.

In general, escalator 12 includes a truss 14 formed of a plurality of longitudinal truss members and cross braces and supports, which are welded together to provide a rigid support for tracks, which in turn support guide rails associated with an endless belt. Steps 16 are attached to the endless belt. Balustrades 18 and 20 are disposed on opposite sides of the steps 16, with the balustrades guiding continuous flexible handrails, as is well known in the art. The endless belt and steps 16 are driven by suitable drive means, for transporting passengers between upper and lower landing portions 21 and 23, respectively, of the escalator. The hereinbefore mentioned U.S. Pat. No. 3,707,220 may be referred to if further details relative to escalator construction are desired.

The present invention permits escalator 12 to be installed in its operating position with the steps 16 and balustrades 18 and 20 pre-assembled with the escalator truss 14, as the escalator 12 is supported from below, requiring no overhead rigging.

Installation apparatus 10 includes three main sub-assemblies, a track and support sub-assembly 22, a scissors lift sub-assembly 24 mounted on the track and support assembly 22, and an adjustable truss support and locator sub-assembly 26, pivotally mounted on the scissors lift sub-assembly 24.

Track and support sub-assembly 22 includes first and second spaced wheel track and support channels 28 and 30, respectively. Channels 28 and 30 are fixed in spaced, horizontal relation via suitable cross braces and tie plates, shown generally at 32, which may be welded or otherwise suitably fixed to the channel members 28 and 30. The spaced channel members 28 and 30 and cross bracing members form a rectangularly shaped assembly, with four swivel casters 34 being suitably fixed to the assembly at its four corners. Swivel casters 34 enable the installation apparatus 10 to be maneuvered into position relative to a pit 36 in the floor 38 of the lower landing, for receiving the truss portion associated with the lower landing portion, and relative to an opening in the upper landing which includes a support wall 40 for supporting the truss portion associated with the upper landing portion 21.

In addition to swivel casters 34, the escalator installation apparatus 10 may be transported from the factory to the job site on trailer wheels, such as trailer wheel 42. Each trailer wheel may be quickly mounted on the track and support sub-assembly via split axle blocks, such as split axle block 44 for trailer wheel 42. A pair of spaced, vertically oriented hydraulic cylinders 46 and 48 may be attached to the track and support sub-assembly 22, to lift the installation apparatus 10 to the height desired to assemble, or remove, the trailer wheels. A removable tow bar or hitch 50 completes the over-the-highway adaptation of installation apparatus 10, permitting the assembly to be pulled by a suitable truck tractor.

The scissors lift sub-assembly 24 includes a power-operated scissors arrangement which has first and second spaced similar side portions 52 and 54 interconnected via suitable cross braces 56. Since the two side portions 52 and 54 are similar in construction, only side portion 54 will be described in detail.

Side portion 54 includes inner and outer lower arm members 58 and 60, respectively, with inner lower arm member having first and second ends 62 and 64, respectively, and with the outer lower arm member having first and second ends 66 and 68, respectively. The midpoints of the inner and outer lower arm members 58 and 60 are pivotally interconnected via a suitable bearing-/bushing assembly 70. The first end 66 of the outer lower arm member 60 is pivotally fixed to the channel member 30 via a suitable bearing/bushing assembly 72.

Channel member 30 has its bight portion 78 vertically oriented and facing the vertically oriented bight portion 84 of channel member 28. Slots 79 and 80 disposed in the bight portions 84 and 78 receive an axle assembly 82, the ends of which extend through slots 79 and 80. Suitable wheels or rollers 73 and 74 are rotatably fixed to the ends of the axle assembly 82, with rollers 73 and 74 riding upon the lower leg portion of the associated channel member, such as leg portion 76 of channel member 30. The first end 62 of the inner lower arm member 58 is journaled to roller 74 via a bushing/bearing assembly 86, and the like inner lower arm member of side 52 is similarly fixed to roller 73.

Side 54 additionally includes inner and outer upper arm members 88 and 90, respectively, with the inner upper arm member 88 having first and second ends 92 and 94, respectively, and with the outer upper arm member 90 having first and second ends 96 and 98, respectively. The first end 92 of the inner upper arm member 88 is pivotally attached to the second end 68 of the outer lower arm member 60, such as via bearing-/bushing assembly 100, and the first end 96 of the outer upper arm member 90 is pivotally attached to the second end 64 of the inner lower arm member 58 via bearing/bushing assembly 102. The second ends 94 and 98 of the inner and outer upper arm members 88 and 90 are pivotally interconnected via a bearing/bushing assembly 104.

Figure 2:
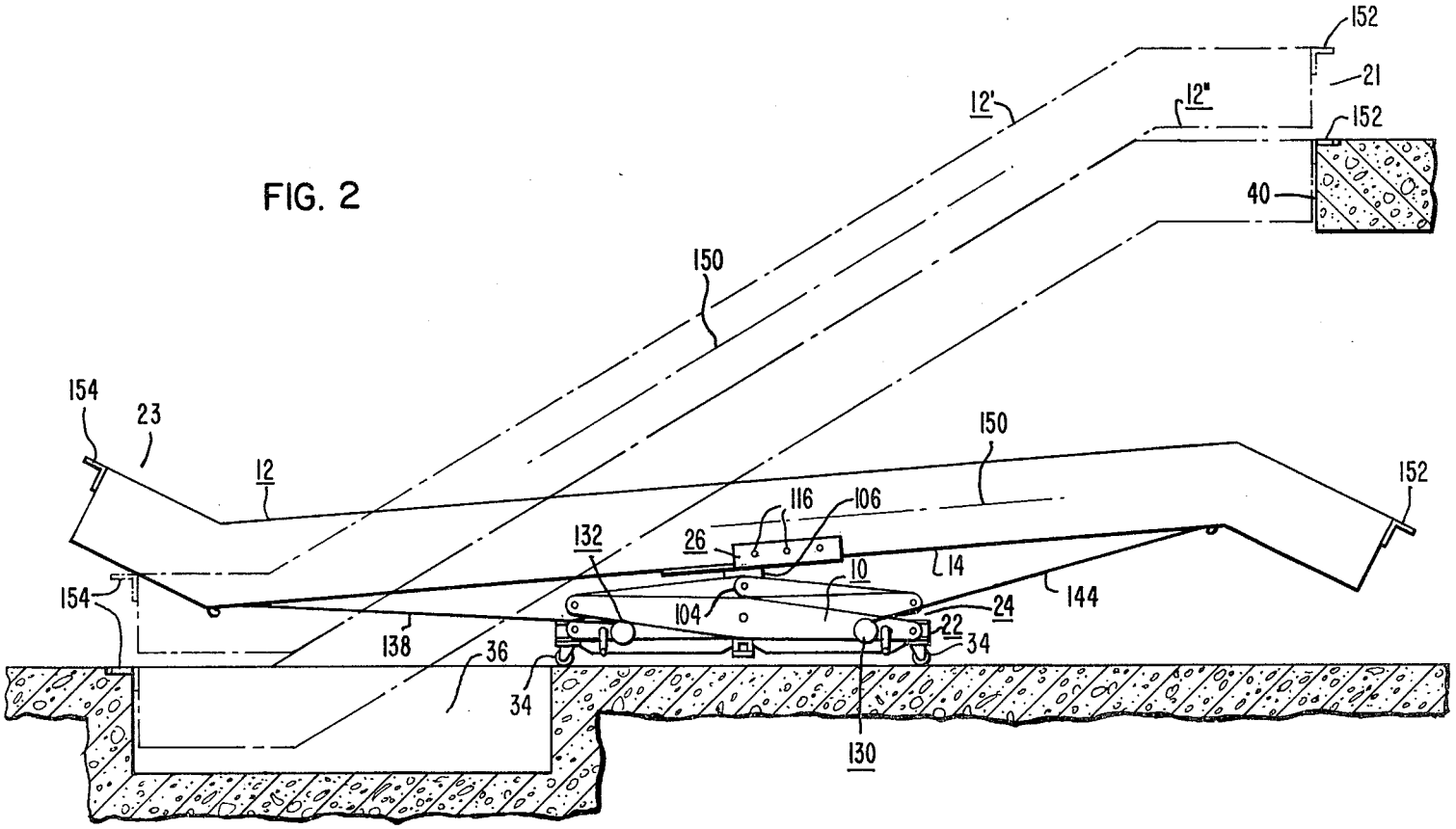
FIG. 2 is a diagrammatic view, in elevation, which illustrates retracted and elevated positions of the installation apparatus shown in FIG. 1.

The escalator truss support and locator sub-assembly 26 includes suitable spaced bearing block members such as bearing block member 106 shown in FIG. 2, with the bearing block members receiving an axle or shaft which extends between the upper interconnected ends of the inner and outer upper arm members 88 and 90, on each side of the scissors lift sub-assembly 24.

A suitable truss support structure having first and second sides 110 and 112, respectively, is attached to the bearing blocks 106. Each of the sides 110 and 112, such as side 112, includes an angle member having a vertically oriented side or leg portion 114, with leg portion 114 having a plurality of openings 116 disposed therein. The angle member additionally includes a support portion 118, oriented perpendicularly to the vertically oriented side portion 114. The lower longitudinal truss member of the escalator truss 14 is placed on the support portion 118, and the truss 14 is secured to the truss support and locator sub-assembly 26 via a plurality of bolts which extend through openings 116 and through aligned openings in the longitudinal truss members of truss 14. The side portions 110 and 112 are spaced via suitable bracing members 120, which include suitable width adjustment means which enables the spacing between the side portions 110 and 112 to be adjusted to accommodate the width of the escalator to be transported.

The scissors lift sub-assembly 24 additionally includes a pair of spaced hydraulic cylinders, such as hydraulic cylinder 122. One end of hydraulic cylinder 122 is pivotally fixed to the track and support sub-assembly 22, at the end thereof which is opposite the end having slots 79 and 80. The other end of hydraulic cylinder 122 is pivotally fixed to a suitable cross brace member 124 which extends between the inner lower arm members 58. Thus, when hydraulic cylinder 122 and its companion cylinder, are retracted, the scissors lift will be pulled down into its retracted position, in which rollers 73 and 74 will have moved to the outer ends of their respective travel paths. When hydraulic cylinder 112 and its companion cylinder are extended, they operate the scissors lift from the retracted position to the extended position shown in FIG. 1, with rollers 73 and 74 being directed along the guide tracks defined by the spaced channel members 28 and 30 towards the opposite extreme of their respective travel paths, i.e., towards the midpoint of the track and support sub-assembly 22.

Escalator installation apparatus 10 is completed by first and second manually operated cable and winch assemblies 130 and 132, respectively. Cable and winch assembly 130 includes a drum or reel 134 which is fixed to the inner lower arm member 58, an operating handle 136, a cable 138, and a suitable brake and ratchet arrangement. In like manner, cable and winch assembly 132 includes a drum or reel 140 fixed to the outer lower arm member 60, an operating handle 142, a cable 144, and a suitable brake and ratchet arrangement. Cables 138 and 144 are attached to opposite ends of truss 114, such as via the hooks illustrated, providing tilt control for orientation of the escalator during its installation via the pivotally mounted truss and locator support sub-assembly 26.

In operation, the escalator installation apparatus 10 is towed to the job site via removable trailer wheels 42 and tow bar 50. Hydraulic cylinders 46 and 48 are extended slightly to remove the weight from the trailer wheels 42, permitting them to be removed. Hydraulic cylinders 46 and 48 are then slowly retracted to lower the installation apparatus 10 to floor level, enabling it to be positioned under the previously delivered truss assembly. The truss assembly may be sitting on the building floor or on stairway trailer trucks. The installation apparatus is raised to contact the truss which is then bolted to the leg portion of 114. The assembly is then moved to the final installation site in the associated building on the swivel casters 34, being directed into the orientation shown in solid outline in FIG. 2, relative to pit 36 and support wall 40. Hydraulic cylinder 122, and its companion cylinder, are then slowly extended to vertically lift the escalator 12. Winches 130 and 132 are manually operated to tilt the escalator 12 to the proper orientation. For example, the longitudinal axis 150 of truss 14, which is substantially horizontally oriented when the installation apparatus 10 is completely retracted, is oriented to about 30° from the horizontal when the escalator installation apparatus 10 is extended. The installation apparatus 10 is adjusted to initially move the escalator 12 vertically to an elevation higher than the floor level of the upper landing, as illustrated in phantom view 12' in FIG. 2. Then, by adjusting the hydraulic cylinder 122 and its companion cylinder, and by operating the tilt control provided by the cable and winch assemblies 130 and 132, the upper end of the escalator 12 is adjusted until an angle member 152 fixed to its upper end rests on the upper edge of the support wall 40, as illustrated by the phantom view 12'' in FIG. 2. The lower end of escalator 12 may then be lowered into the pit 36, until an angle member 154 fixed to its lower end rests upon the edge of the pit opening, as shown in FIG. 2.

The bolts which were inserted through openings 116 of the truss support and locator sub-assembly 26 are now removed, the installation apparatus 10 is retracted, and the apparatus 10 may be moved out from under the escalator 12 in any desired direction on its swivel casters. The trailer wheels 42 and 50 are then reinstalled, and apparatus 10 is ready to be towed back to the factory for re-use.

In summary, there has been disclosed new and improved escalator installation apparatus which supports the escalator from the bottom of its truss, permitting the escalator to be installed almost completely pre-assembled, including its steps and balustrades. The installation apparatus is portable, permitting it to be shipped to the job site on a set of trailer wheels. The trailer wheels are then removed, the escalator attached, and the combination maneuvered into its final operating position via swivel casters. Complete control over vertical height, and angle of orientation, are provided by a hydraulically operated scissors lift, and a pivotable mounting assembly on the scissors lift, which is easily oriented to the proper angle via cable and winch assemblies. The installation apparatus of the present invention eliminates the need for costly overhead rigging, and the apparatus may be re-used.

What is claimed is:

1. Escalator installation apparatus, comprising:

wheeled support means, scissors lift means mounted on said wheeled support means, said scissors lift means including first and second spaced, interconnected similar side portions each having first and second lower arm members and first and second upper arm members, said first and second lower arm members being pivotally interconnected at substantially their midpoints to provide lower ends which are connected to said wheeled support means, and upper ends, said first and second upper arm members having first ends pivotally connected to the upper ends of the first and second lower arm members, respectively, and pivotally interconnected second ends, cylinder means operable to cause said scissors lift means to occupy a predetermined vertical position, between predetermined retracted and extended positions, escalator truss support and locator means pivotally mounted on said scissors lift means, on a pivot axis which extends between the pivotally interconnected second ends of the first and second upper arm members of the first and second side portions of said scissors lift means, said escalator truss support and locator means being adapted to support an escalator truss having a longitudinal axis such that when said scissors lift means is in its retracted position the longitudinal axis is substantially horizontally oriented, and when the scissors lift means is extended to elevate the escalator truss support and locator means, the first and second upper arm members operate from a substantially horizontal orientation to an inclined orientation which permits the longitudinal axis of the escalator truss to be oriented to the desired angle about the pivot axis, said means for pivoting said escalator truss support and locator means about said pivot axis, to provide rotational adjustment of the escalator truss within the limits established by the upper arm members of the scissors lift means, as well as the vertical adjustment provided by said scissors lift means.

2. The escalator installation apparatus of claim 1 wherein the wheeled support means includes first and second spaced, interconnected wheel track and support channel members which define a rectangular structure having four corners, swivel casters fixed to the rectangular structure at its four corners, and wherein the lower ends of the first lower arm members of the first and second side portions are pivotally fixed to the first and second wheel track and support channel members, respectively, and the lower ends of the second arm members of the first and second side portions are slidably fixed to the first and second wheel track and support channel members, respectively.

3. The escalator installation apparatus of claim 1 wherein the means for pivoting the escalator truss support and locator means within the pivot range established by the angles of the upper arm members of the scissors lift means includes at least one tilt control cable attachable to the escalator truss, and at least one winch associated therewith.

4. The escalator installation apparatus of claim 1 wherein the means for pivoting the escalator truss support and locator means within the pivot range established by the angles of the upper arm members of the scissors lift means includes first and second tilt control cables attachable to the escalator truss, and first and second winches associated therewith, respectively.

* * * * *